US005357774A

United States Patent [19]

Klages et al.

[11] Patent Number: 5,357,774

[45] Date of Patent: Oct. 25, 1994

[54] SEAL HEAD FOR TUBE EXPANSION APPARATUS

[76] Inventors: Gerrald A. Klages, 109 Anderson Street, Woodstock, Ontario, Canada, N4S 8X5; Frank S. Krasnicki, 308-274 Kingswood Drive, Kitchener, Ontario, Canada, N2E 2K2; Murray R. Mason, R.R. # 8, Woodstock, Ontario, Canada, N4S 7W3

[21] Appl. No.: 106,728

[22] Filed: Aug. 16, 1993

Related U.S. Application Data

[63] Continuation of Ser. No. 860,553, Mar. 30, 1992, Pat. No. 5,235,836, which is a continuation of Ser. No. 489,109, Mar. 6, 1990, abandoned.

[51] Int. Cl.[5] ..... B21D 39/08

[52] U.S. Cl. ..... 72/62; 72/58; 29/421.1

[58] Field of Search ..... 72/56, 58, 59, 60, 61, 72/62; 29/421.1

[56] References Cited

U.S. PATENT DOCUMENTS

| | | | |
|---|---|---|---|
| 2,203,868 | 6/1940 | Gray et al. . | |
| 2,458,854 | 1/1949 | Hull et al. . | |
| 2,837,810 | 6/1958 | Ekholm . | |
| 3,359,624 | 12/1967 | Cours et al. . | |
| 3,542,076 | 11/1970 | Richardson . | |
| 3,625,040 | 12/1971 | Gain . | |
| 4,317,348 | 3/1982 | Halone et al. | 72/58 |
| 4,320,568 | 3/1982 | Herrod et al. . | |
| 4,393,674 | 7/1983 | Rasmussen . | |
| 4,460,200 | 7/1984 | Rasmussen et al. . | |
| 4,641,407 | 2/1987 | Blevins et al. . | |
| 4,761,981 | 8/1988 | Kelly . | |
| 4,761,982 | 8/1988 | Snyder . | |
| 4,779,333 | 10/1988 | Rabe et al. . | |
| 4,827,605 | 5/1989 | Krips et al. . | |
| 5,233,854 | 8/1993 | Bowman et al. . | |
| 5,233,856 | 8/1993 | Shimanovski et al. . | |
| 5,235,836 | 8/1993 | Klages et al. | 72/58 |
| 5,239,852 | 8/1993 | Roper . | |

FOREIGN PATENT DOCUMENTS

| | | |
|---|---|---|
| 165134 | 10/1982 | Japan . |
| 835359 | 5/1960 | United Kingdom . |

*Primary Examiner*—David Jones

[57] ABSTRACT

An apparatus is provided for filling a tube with fluid and for pressurizing the tube, in order to expand and form it within a die for example. The apparatus provides a high flow-low pressure fluid circuit for quickly filling and draining the tube, together with a separate high pressure-low flow fluid circuit for pressurizing and depressurizing the tube. The high pressure circuit of the apparatus comprises a shaft having a longitudinal bore communicating with a high pressure fluid source and control means; tube sealing means adjacent the forward end of the shaft for sealing the tube when the shaft is engaged with the tube and high pressure fluid flows into the tube; and shaft reciprocating means for advancing and retracting the shaft. The high flow circuit of the apparatus comprises: a forwardly open shroud, housing the forward end of the shaft when retracted and having a rearward opening slidably and sealably engaging the forward end of the shaft rearward of the tube sealing means, the interior of the shroud communicating with a high flow-low pressure fluid source and control-means; external seal means about the forward opening of the shroud for sealing an external surface adjacent an end of the tube; and shroud reciprocating means for advancing and retracting the shroud. In operation therefore: the shroud is advanced to seal the external surface; the tube is filled with low pressure fluid; the shaft is advanced and the tube sealing means engaged; the tube is pressurized; and the process is reversed to release the tube.

16 Claims, 6 Drawing Sheets

SEAL HEAD FOR TUBE EXPANSION APPARATUS

This is a continuation of application Ser. No. 07/860,553, filed Mar. 30, 1992 assigned U.S. Pat. No. 5,235,836 issued on Aug. 17, 1993, which is a continuation of application Ser. No. 07/489,109, filed Mar. 6, 1990, abandoned.

BACKGROUND OF THE INVENTION

The invention is directed to means for filling a tube or similar workpiece with fluid and for pressurizing the fluid within the workpiece.

Various manufacturing and industrial processes require that tubes or vessels be filled with liquid and then pressurized. Examples of such processes include: expanding tubes within a forming die cavity as described in U.S. Pat. Nos. 4,567,743 and 4,829,803 to Cudini; expanding a tubular liner to form a composite lined pipe as described in U.S. Pat. No. 3,359,624 to Courset al; and pressure testing of fabricated pressure vessels. In general, such processes include the following steps: sealing of the openings of the tube or vessels workpiece; filling of the workpiece with fluid; pressurizing the fluid within the workpiece to achieve the particular desired result such as forming, expanding or pressure testing; depressurizing the fluid; draining the fluid; and removing the sealing means to release the workpiece.

Conventional devices to carry out the above processes generally utilize a sintile sealing means which operates to prevent fluid leakage during the low pressure filling and draining stages, as well as during the high pressure pressurized stages. Examples of such devices are described in U.S. Pat. No. 4,788,843 to Seaman et al. and U.S. Pat. No. 3,625,040 to Gain. When such devices are used in a repetitive high volume manufacturing environment, such as automobile parts manufacturing for example, the sealing means are generally the first part of the device to fail, and are therefore the cause of significant delay and machine downtime. Such sealing means relies upon the contact between the workpiece and a flexible gasket to maintain a fluid seal. Workpieces often have burrs on the edges of their openings which damage the gasket, and in any case through repeated use the flexible gasket eventually fails necessitating replacement. Conventional devices often do not include means to accurately predetermine or limit the degree of flexible gasket compression. A gasket which is compressed to an inadequate degree will leak, whereas an over compressed gasket will fail prematurely due to material fatigue or over stressing. Frequent replacement of such gaskets results in costs associated with maintenance and inefficiency during machine downtime.

The failure of such conventional sealing means also subjects the machine operators and adjacent machinery to the risk of harm from the leakage of high pressure fluid. Some form of machine guard or personal protective equipment may often be required by various local safety regulations in association with conventional devices as a result.

In such conventional devices fluid often enters the workpiece via a single input-output circuit of piping. In order to quickly fill and drain the workpiece with fluid a relatively large diameter piping circuit is desirable, whereas to pressurize the fluid only a relatively small diameter piping circuit is required due to the low quantity of flow and a small diameter is desirable due to the increased wall thickness required if large diameter pipes are used for high pressure fluid circuits. In U.S. Pat. No. 3,359,624 to Cours et al. a device is described which includes a high flow-low pressure circuit for filling and draining, as well as low flow—high pressure circuit for pressurizing the liquid. Such conventional devices reduce the amount of time required to fill and drain the workpiece but suffer from the disadvantage that costly valving and valve controls are required to separate the two circuits. In addition, the valving adds a further process time to operate, and introduces additional maintenance costs.

BRIEF SUMMARY OF THE INVENTION

The invention provides a novel apparatus to fill a tube or like workpiece with fluid which reduces the costs of operation and maintenance, reduces the processing time required, and reduces or eliminates the risks of injury and machinery damage associated with the conventional devices described above.

The invention provides an apparatus for filling a tube with fluid comprising:

a shaft, having a forwardly open longitudinal bore rearwardly communicating with a high pressure fluid source;

tube sealing means adjacent the forward end of said shaft, for sealing said tube when said shaft is advanced into engagement with said tube;

shaft reciprocating means for advancing and retracting the forward end of said shaft into and out of engagement with said tube;

a forwardly open shroud, housing the forward end of said shaft when withdrawn, and having a rearward opening slidably engaging the forward end of said shaft rearward of said tube sealing means, tile interior of said shroud communicating with a low pressure fluid source;

external sealing means, adjacent the forward end of said shroud, for sealing an external surface adjacent an end of said tube;

shroud reciprocating means, engaging said shroud, for advancing and retracting said shroud forward and away from said external surface;

low pressure fluid control means, communicating with said low pressure fluid source, for filling said tube with fluid when said shroud is advanced and said external sealing means seals said external surface before advancing said shaft, and for draining fluid from said tube after retraction of said shaft; and high pressure fluid control means, communicating with said high pressure fluid source, for further filling and pressurizing said tube when said shaft is advanced into engagement with said tube and said tube sealing means seals said tube, and for depressurizing said tube before said shaft is retracted.

In addition the invention provides an apparatus for filling a tube with fluid comprising:

a shaft, having a longitudinal axis, including: a rod having a forwardly open longitudinal bore rearwardly communicating with a fluid source; and a sleeve outward of said rod;

tube sealing means, adjacent the forward end of said shaft, for sealing said tube when said shaft is advanced into engagement with said tube, including: a rod ring, connected to the forward end of said rod, a sleeve ring, connected to the forward end of said sleeve; an elastomeric ring between said rod ring and said sleeve ring having an annular surface for sealingly engaging the surface of said tube; and displacing means for axially displacing said rod and said sleeve relative to each other, axially compressing and decompressing, and radially expanding and contracting said elastomeric ring to engage and disengage said tube; and wherein said rod ring and sleeve ring have a greater axial extent than said elastomeric ring adjacent its annular surface, whereby said annular surface is nested inwardly between said rod and sleeve rings;

shaft reciprocating means for advancing and retracting the forward end of said shaft into and out of engagement with said tube;

fluid control means, communicating with said fluid source, for filling and pressurizing said tube when said shaft is advanced into engagement with said tube and said tube sealing means seals said tube, and for depressurizing said tube before said shaft is retracted.

DETAILED DESCRIPTION

Figure 1:
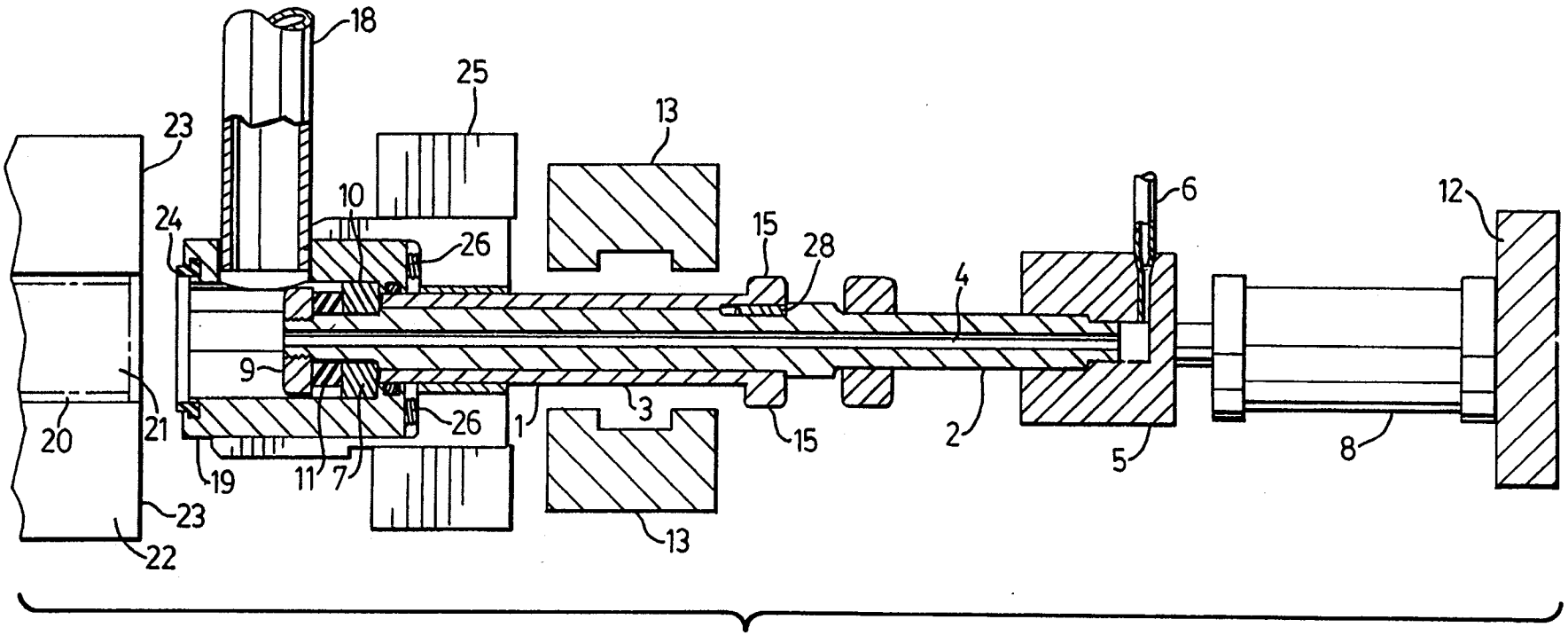
FIG. 1 shows an axial cross-sectional view of one embodiment of the invention with its shaft in a fully withdrawn position and its shroud in a fully retracted position.

In the drawings the invention is applied in a tube forming process wherein a tube 20 is to be filled with liquid through an opening 21. The tube 20 is retained between the interior faces of a mating pair of forming die blocks 22. It will be understood that the following description is equally applicable to any process where a workpiece is to be filled and pressurized through such an opening 21.

Referring to FIG. 1 a first embodiment of the invention is illustrated. A shaft 1, having a longitudinal axis, includes a rod 2 and a sleeve 3 outward of the rod 2. The rod 2 has a forwardly open longitudinal bore 4 rearwardly communicating with a fluid source via end cap 5 and high pressure conduit 6 in the particular embodiment shown.

Figure 4:
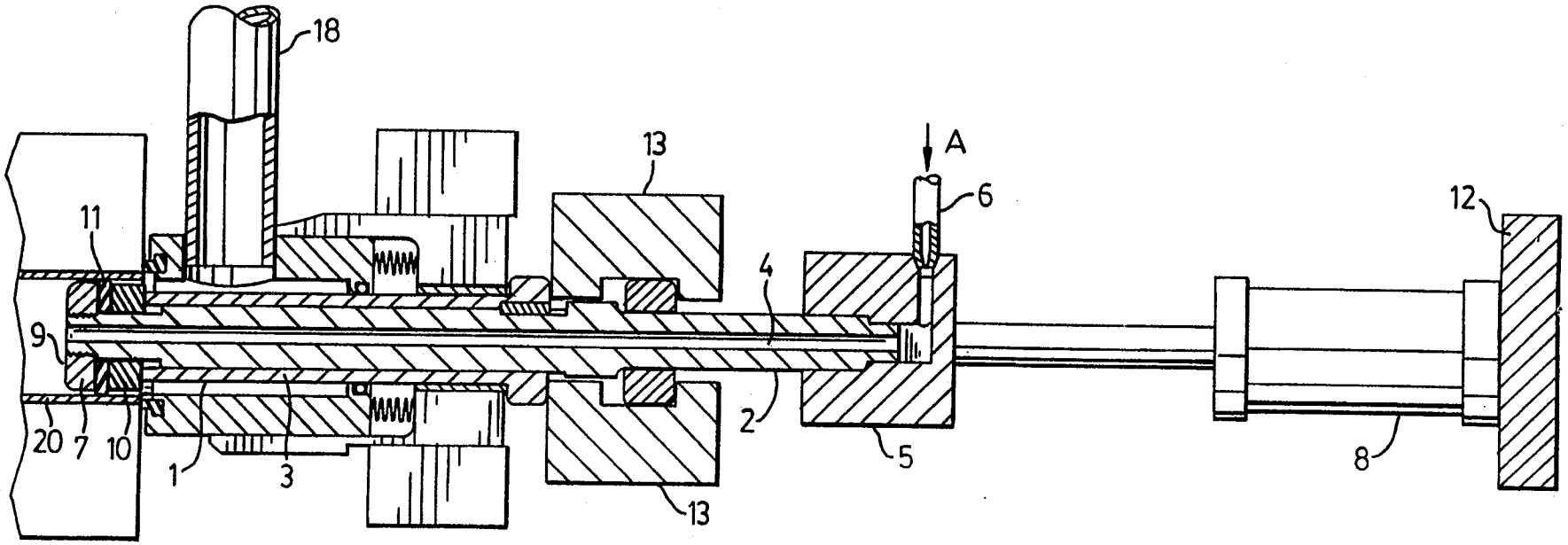
FIG. 4 shows a like view with the internal sealing means sealing the interior of the tube and high pressure fluid pressurizing the fluid in the interior of the tube as indicated by the arrow A.
Figure 6:
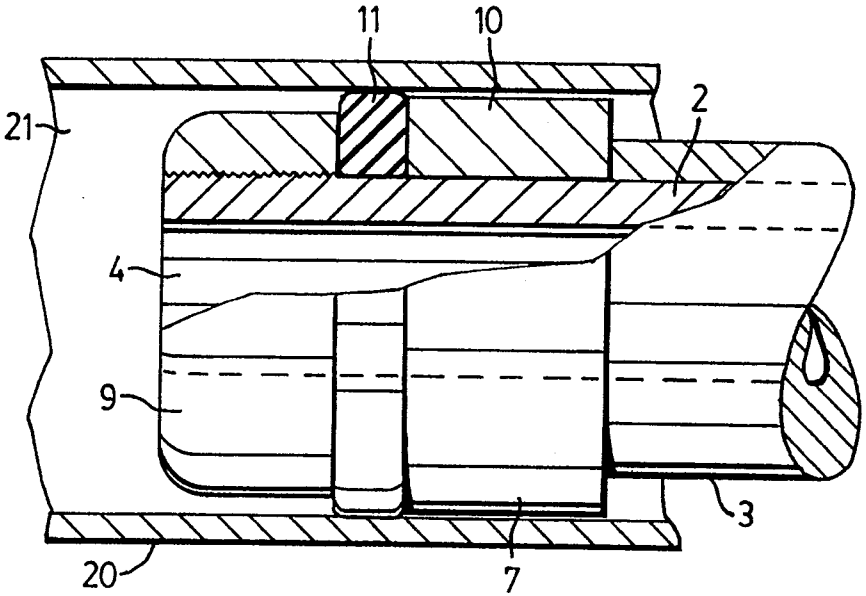
FIGS. 5 and 6 show detailed views of the forward end of the shaft and internal sealing means corresponding to FIGS. 3 and 4 respectively.
Figure 5:
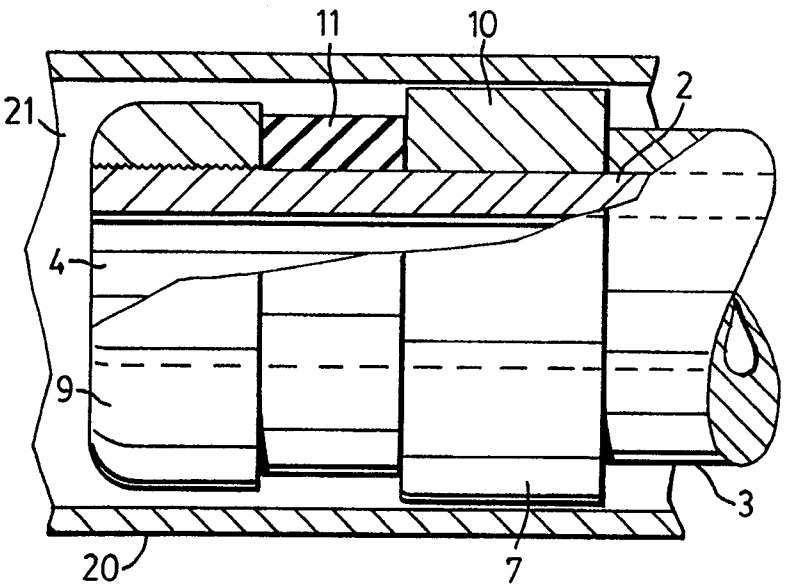

Referring to FIGS. 1 and 4 tube sealing means comprising inner sealing means 7 are provided, adjacent the forward end of the shaft 1, for sealing the interior of the tube 20 when the shaft 1 is inserted into the tube 20. Shaft reciprocating means 7 may comprise, as shown, a double acting hydraulic cylinder 8 engaging the rearward end of the shaft 1 and a stationary member 12, and acting in a direction parallel to the axis of the shaft 1. The cylinder 8 provides means for advancing and retracting the shaft 7 into engagement with the tube 20 by inserting and withdrawing the forward end of the shaft 1, into and out of the interior of the tube 20 through the opening 21 in the end of the tube 20.

The inner sealing means 7 includes: a rod ring 9, connected to the forward end of the rod 2, and having a rearward radially extending face; a sleeve ring 10 connected to the forward end of the sleeve 3 and having a forward radially extending face; and an elastomeric ring 11 between the rearward face of the rod ring 9 and the forward face of the sleeve ring 10. Displacing means, to be fully described below, are included in the inner sealing means 7 for axially displacing the rod 2 and sleeve 3 relative to each other thereby axially compressing and decompressing, and radially expanding and contracting the elastomeric ring 11 to engage and disengage the interior of the tube 20.

Figure 3:
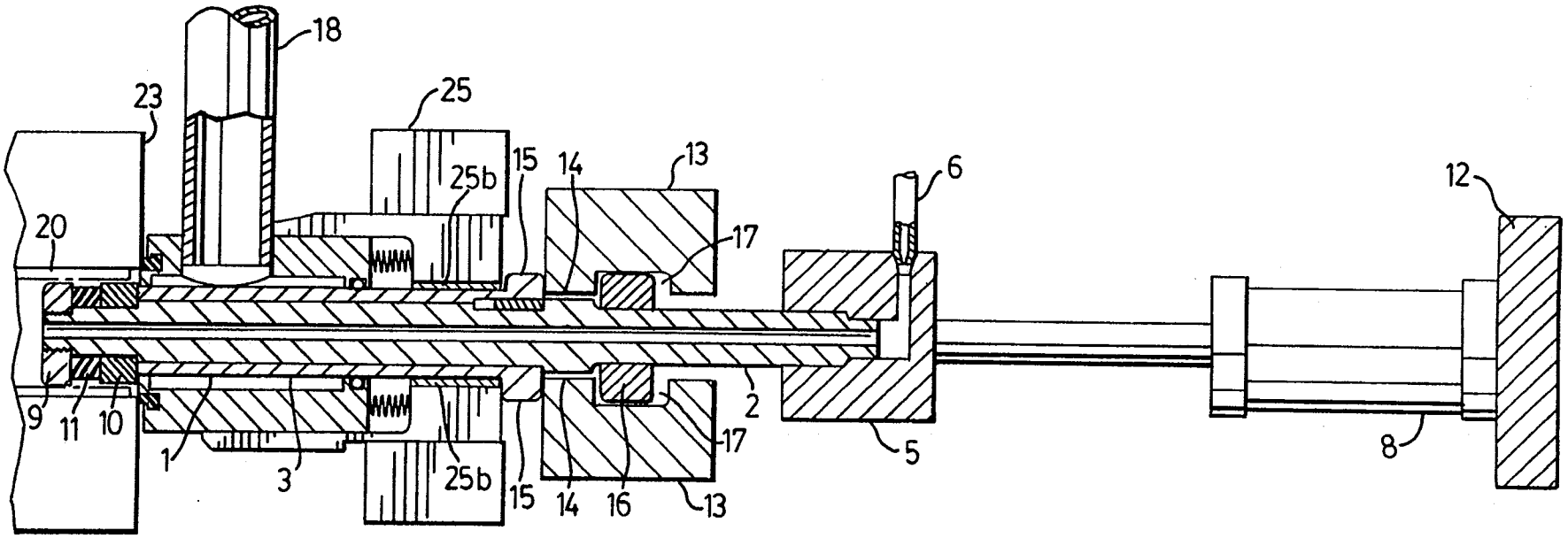
FIG. 3 shows a like view with the shaft fully inserted into the interior of the tube.

In a first embodiment of the invention, the following sequence of operations is carried out. Referring to FIG. 1, initially the shaft 1 of the device is in a fully withdrawn position and the opening 21 of the tube 20 is aligned with the longitudinal axis of the shaft 1. Referring to FIG. 3, the forward end of the shaft 1 is inserted into the interior of the tube 20 by extending the hydraulic cylinder 8. The elastomeric ring 11 has an outer diameter less than the diameter of the rod ring 9 and the sleeve ring 10 whereby its annular sealing surface is nested inwardly between the rod and sleeve rings in order to protect it during insertion and withdrawal. The edges of the tube openings 21 often have burrs remaining from cutting operations or may otherwise abrade the annular sealing surface of an exposed elastomeric ring 11 thereby reducing its serviceable life. The elastomeric ring 11 is inserted a distance beyond the outer edge of the tube 20 in order to engage a relatively smooth area of the interior wall of the tube 20. To further aid smooth insertion and to allow for minor misalignment of the tube 20, the outer dimensions of the rod ring 9 may be less than the other dimensions of the sleeve ring 10 and the forward edges of the rod ring 9 may be rounded. Referring to FIG. 4, the displacing means are activated to axially displace the rod 2 and sleeve 3 relative to each other. As a result the rod ring 9 and sleeve ring 10 are drawn toward each other thereby axially compressing and radially expanding the elastomeric ring 11. The outer surface of the elastomeric ring 11 engages the interior surface of the tube 20 sealing the tube 20. Fluid control means, communicating with a fluid source and the longitudinal bore 4 via end cap 5 and high pressure conduit 6, are then activated to fill the tube 20 with fluid and to pressurize the tube 20 as indicated by the arrow A. Venting of entrapped air from the tube 20 may be carried out by a valved vent conduit at the opposite end of the tube 20 or at some point along its length. Upon completion of the desired procedure which requires a pressurized workpiece, the above operating sequence is reversed. The fluid control means are activated to depressurize and drain the tube 20 of water via the longitudinal bore 4 and high pressure conduit 6. The displacing means are then activated to decompress and radially contract the elastomeric ring 11 disengaging it from the interior of the tube 20. Thereafter the hydraulic cylinder 8 withdraws the forward end of the shaft 1 out of engagement with the interior of the tube 20 to the fully retracted position illustrated in FIG. 1.

Figure 2:
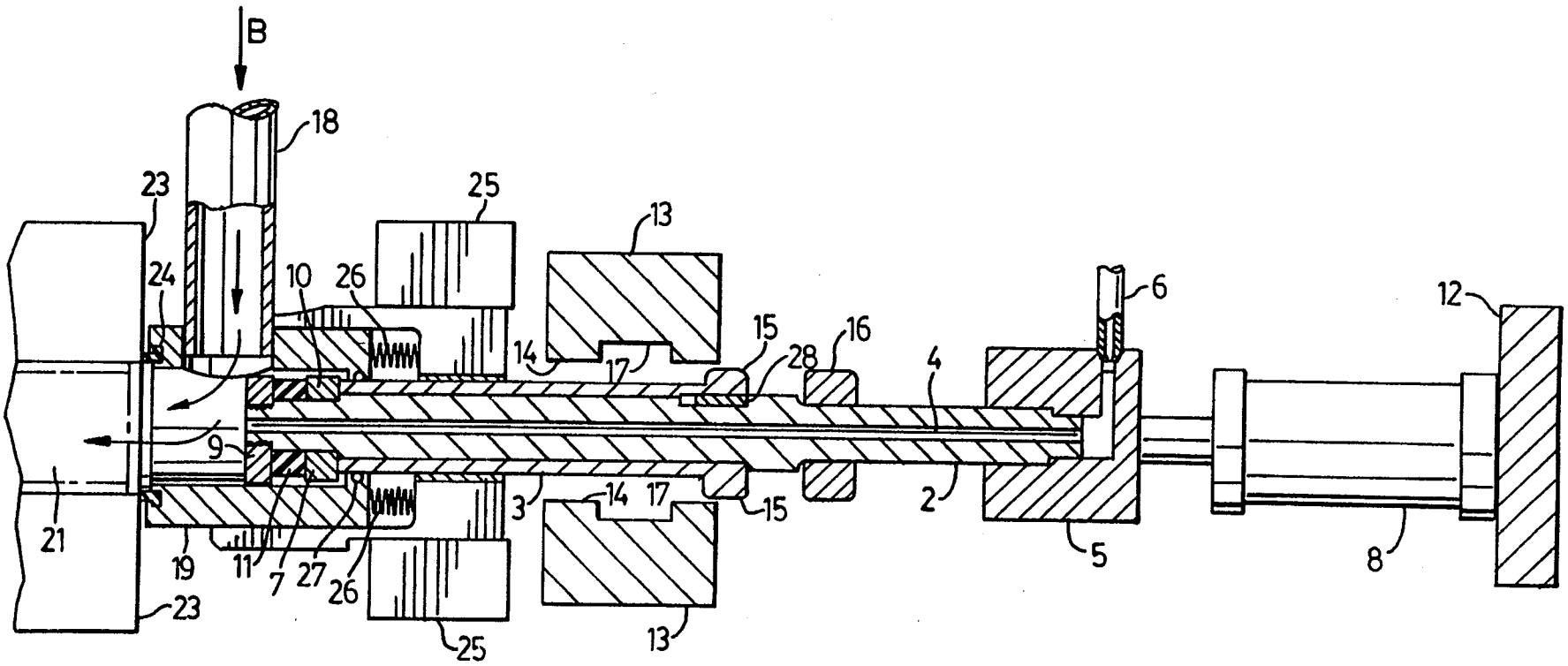
FIG. 2 shows a like view with the shroud fully advanced and fluid flowing through the shroud to fill the tube as indicated by the arrow B.

In a preferred variation of the first embodiment of the invention, the displacing means, for axially displacing the rod 2 and sleeve 3 relative to each other, comprises sleeve backstop means moving radially inwardly toward the axis of the shaft 1, after the shaft 1 has been inserted into the tube. Referring to FIGS. 2 and 3, the sleeve backstop means may comprise two oppositely radially movable blocks 13 having a semi-annular inner surface 14 through which the shaft 1 extends. The sleeve 3 may include an annular sleeve stop ring 15 protruding outwardly of the rearward end of the sleeve 3. In operation therefore the movable blocks 13 are initially positioned radially withdrawn from the shaft 1 in order to allow the shaft 1 to be inserted into the tube 20, as shown in FIGS. 1 and 2. Referring to FIG. 3, when the shaft 1 is fully inserted, the movable blocks 13 are moved radially inwardly toward the axis of the shaft 1 to engage the rearward end of the sleeve 3 and thereby to prevent rearward movement of the sleeve 3. Referring to FIG. 4, the hydraulic cylinder 8 is activated to rearwardly withdraw the rod 2 to seal the interior of the tube 20. Since the movable blocks 13, engaging the rearward end of the sleeve 3, prevent the sleeve 3 from moving rear-wardly, the withdrawal of the rod 2 results in relative axial displacement between the rod 2 and sleeve 3. Upon completion of the pressurization process, the above sequence of operations is reversed Go release the tube 20.

In order to accurately predetermine or limit the degree of compression of the elastomeric ring 11, rod limiting means may be included for limiting the extent to which the rod 2 may be withdrawn to seal the interior of the tube 20 after the shaft 1 has been inserted into the tube 20 and the movable blocks 13 have engaged the rearward end of the sleeve 3. As described above in relation to conventional devices, if the elastomeric ring 11 is compressed to an inadequate degree leakage may occur. If the elastomeric ring 11 is overcompressed it may fail prematurely due overstressing or fatigue of the elastomeric material. By limiting the extent of rod 2 withdrawal, while securing the sleeve 3 in a stationary position by engaging the movable blocks 13, the degree of compression of the elastomeric ring 11 may be accurately predetermined for optimal sealing and operating life.

The rod limiting means may comprise: a rod abutment protruding from the rod 2 rearward of the sleeve 3; and rod backstop means for moving radially inwardly to engage a rearguard face of the rod abutment. Referring to FIG. 2, in a preferred embodiment the rod abutment comprises a rod stop member 16 threadedly and adjustably engaging the rod 2.

The rod backstop means, referring to FIG. 2, may comprise two semi-annular interior grooves 17 in the semi-annular inner surface 14 of the movable blocks 13, and the rod stop member 16 may comprise a ring receivable in the grooves 17. For example: a rod stop member 16 may include two outwardly knurled nuts engaging a threaded portion of the rod 2 whereby rotating the nuts in opposing directions will lock them at a desired axial position upon the rod 2. In operation therefore referring to FIG. 3, when the shaft 1 is inserted into the tube 20, the movable blocks 13 are moved inwardly simultaneously to engage the rearward end of the sleeve 3 and to receive the rod stop member 16 within the grooves 17. Preferably the forward movement of both the sleeve 3 and the rod 2 are limited by positive contact to accurately set the extent to which the shaft 1 is inserted into the tube 20, and to prevent forward axial displacement of the rod 2 relative to the sleeve 3. Such forward axial displacement would result in disengagement of the elastomeric ring 11 from the rod ring 9 and the sleeve ring 10 causing unnecessary wear, or would result in axial stretching of an adhering elastomeric ring 11 further reducing its service life. A stationary block 25 may slidably support the forward end of the shaft 1 within bearings 28 between the inner sealing means 7 and the sleeve stop ring 15. When the shaft is moved forwardly the forward surface of the sleeve stop ring 15 abuts the rearward surface of the stationary block 25. The movable blocks 13 are moved inwardly to engage the rearward end of the sleeve stop ring 15 when the rod 2 is withdrawn. The forward surface of the rod stop member 16 is housed within the groove 17 of the movable blocks 13. The cylinder 8 is then activated to withdraw the rod 2 to seal the interior of the tube 20. The extent to which the rod 2 is withdrawn is limited when the rearward surface of the rod stop member 16 abuts the rearward shoulder of the groove 17.

The preceding description has disclosed a first embodiment of the invention which utilize a single high pressure circuit to fill a workpiece with fluid and to pressurize the fluid. Such a first embodiment is adequate where the volume of fluid required to fill the workpiece is relatively low. As will be apparent to those skilled in the art, the diameter of the longitudinal bore 4 limits the quantity of fluid which may practically be conducted within any given period of time.

The diameter of the longitudinal bore 4 is limited by the tube opening 21, the required radial thickness of the elastomeric ring 11, and the required rod 2 wall thickness. Therefore, when relatively large quantities of fluid are required to fill a workpiece through a relatively small opening 21, the time required to fill the workpiece with fluid conducted through the longitudinal bore 4 may be considered excessive especially when the apparatus is used in a repetitive high volume manufacturing environment. In such a case therefore, a preferred second embodiment of the invention may utilize two fluid circuits namely a high flow-low pressure circuit for filling and draining the workpiece and a low flow-high pressure circuit for pressurizing and depressurizing the fluid within the workpiece.

Referring to FIG. 4, a second embodiment of the invention is illustrated which utilizes a high flow-low pressure circuit and a low flow-high pressure circuit. As described above, the high pressure circuit conducts fluid via the high pressure conduit 6, end cap 5 and longitudinal bore 4 as indicated by the arrow A. Referring to FIG. 2, the low pressure circuit conducts fluid through members of relatively larger internal dimensions, namely a low pressure conduit 18 and a shroud 19, into the tube opening 21 as indicated by the arrow B.

In the preferred second-embodiment illustrated in the drawings, a shaft 1 has a forwardly open longitudinal bore 4 rearwardly communicating with a high pressure fluid. Inner sealing means 7 are provided adjacent the forward end of the shaft 1 for sealing the interior of the tube 20 when the shaft 1 is inserted into the tube 20. A particular preferred embodiment of such inner sealing means 7 has been described above in relation to a first embodiment of the invention, however, it will be understood that various other tube sealing means 7 may be adapted to perform the same function in association with the second embodiment of the invention described herein.

Shaft reciprocating means, in the form of a double acting hydraulic cylinder 8, are provided for inserting and withdrawing the forward end of the shaft 1 into and out of the interior of the tube 20. As described above, the cylinder 8 engages the rearward end of the shaft 1 and a stationary member 12. The cylinder 8 acts in a direction parallel to the axis of the shaft 1.

Turning now to the low pressure circuit, and with reference to FIG. 1, a forwardly open shroud 19 houses the forward end of the shaft 1 when withdrawn. The shroud 19 has a rearward opening slidably engaging the forward end of the shaft 1 rearward of the inner sealing means 7. The interior of the shroud 19 communicates with a low pressure fluid source via low pressure conduit 18. The shroud 19 performs three functions as illustrated, namely, as a fluid conductor in the low pressure circuit, as a safety guard in the event of failure of the elastomeric ring 11, and as a means to protect the inner sealing means 7 from abrasion or other damage during operation or maintenance of the apparatus.

As described above the drawings illustrate an application of the invention in association with a tube forming process wherein a tube 20 is retained between the interior faces of forming die blocks 22. A rearward external surface 23 of the die blocks 22 is adjacent an end of the tube 20. The gaps between the mating surface of the die blocks 22 and the mating surfaces between the tube exterior and the interior faces of the die blocks, are sufficiently narrow such that leakage of fluid under low pressure is insignificant. External sealing means such as a gasket ring 24 are provided about the forward end of the shroud 19 for sealing the rearward external surface 23 of the die blocks 22. Shroud reciprocating means engage the shroud 19 for advancing and retracting the shroud 19 forward and away from the external surface 23.

Referring to FIG. 2, in a particularly advantageous variation of the second embodiment, the shaft 1 has a radially outwardly extending abutment surface inwardly of the shroud 1 namely an outward portion of the rearward face of the sleeve ring 10 which extends beyond the outer surface of the sleeve 3. The shroud reciprocating means comprises the stationary support 25, and spring means 26 between the stationary support 25 and the shroud 19, for biasing the shroud 19 forwardly toward the external surface 23 of the die blocks 22.

In the second embodiment of the invention, the following sequence of operations is carried out. Referring to FIG. 1, initially the shroud 19 is fully retracted away from the external surface 23 of the die blocks 22, and the shaft 1 is fully withdrawn out of the tube's interior. The outward rearward surface of the sleeve ring 10 abuts and engages the forward inner surface of the shroud 19 under the biasing action of the spring means 26. The cylinder 8 is activated to forwardly move the shaft 1 to an intermediate position, illustrated in FIG. 2, prior to insertion of the shaft 1 into the tube 20. The cylinder 8 forces the rod 2 forward. The rod 2 has an area of enlarged diameter immediately rearward of the sleeve 3 forming a shoulder which abuts the rearward end of the sleeve 3 forcing the sleeve 3 forward. The engagement of the elastomeric ring 11 and the sleeve and rod rings 7 and is thereby maintained. The gasket ring 24 at the forward end of the shroud 19 seals the external surface 23 as the shroud 19 is biased forwardly under the action of the spring means 26. Low pressure fluid control means communicating with a low pressure fluid source are activated to fill the tube 20 with fluid via low pressure conduit 18 and the interior of the shroud 19 as indicated by arrow B. Air from within the tube 20 is vented through means as described above. The fluid in the shroud 19 is under a low pressure such that the biasing force of the spring means 26 maintains the gasket ring 24 sufficiently compressed to retain an adequate fluid seal. An O-ring seal 27 is provided between the rearward opening of the shroud 19 and the outer surface of the shaft 1 to prevent rearward low pressure fluid leakage.

When filling of the tube 20 with low pressure fluid is substantially completed, the shaft 1 is inserted into the tube 20, as illustrated in FIG. 2 and the inner sealing means 7 seals the interior of the tube 20, as illustrated in FIG. 4 and as described fully in association with the first embodiment.

Referring to FIG. 4, high pressure fluid means communicating with a high pressure fluid source are activated to further fill and pressurize the tube 20 as indicated by arrow A, via high pressure conduit 6, end cap 5 and longitudinal bore 4.

Upon completion of the pressurization process, the above sequence of operations is reversed. The high pressure fluid control means are activated to depressurize the tube 20. The inner sealing means 7 are disengaged from the interior of the tube 20 and the shaft 1 is partially withdrawn to the intermediate position shown in FIG. 2. The low pressure fluid control means are activated to drain the fluid from the tube 20 in a direction opposite to arrow B, and air is allowed to reenter the tube 20 via the opened venting means. Upon completion or partial completion of the draining of the tube 20, the cylinder 8 is activated to fully withdraw the shaft 1 to the position illustrated in FIG. 1. The rearward surface of the sleeve ring 10 engages and retracts the shroud 19 against the action of the spring means 26 as the shaft 1 is withdrawn away from the tube 20.

Since the elastomeric seal 11 and the gasket ring 24 are the components of the apparatus most susceptible to wear and damage, they are designed to be easily accessible for rapid replacement during maintenance. The rod ring 9 is internally threaded upon the forward end of the rod 2 and the elastomeric ring 11 and sleeve ring 10 slip over the rod 2. The elastomeric ring 11 is easily replaced by simply removing the rod ring 9. A sliding key 28 is provided engaging the rod 2 and sleeve 3 in order to prevent rotational displacement of the sleeve 3 relative to the rod 2 during removal of the rod ring 9. Such rotational displacement may induce torsional stresses in the elastomeric ring 11 reducing its serviceable life. The gasket ring 24 has an L-shaped cross section in order to flexibly engage a mating gasket groove in the forward end of the shroud 19, likewise for rapid replacement.

Additionally, the apparatus may be rapidly adapted to accommodate a range of tube opening 21 sizes by simply changing the rod ring 9, elastomeric ring and sleeve ring 10 to the desired size. The area of the exterior face 23 enveloped by the shroud 19 and gasket ring 24 may be increased by simply installing shrouds 19 of larger size to accommodate tubes 20 having larger openings 21.

Figure 7:
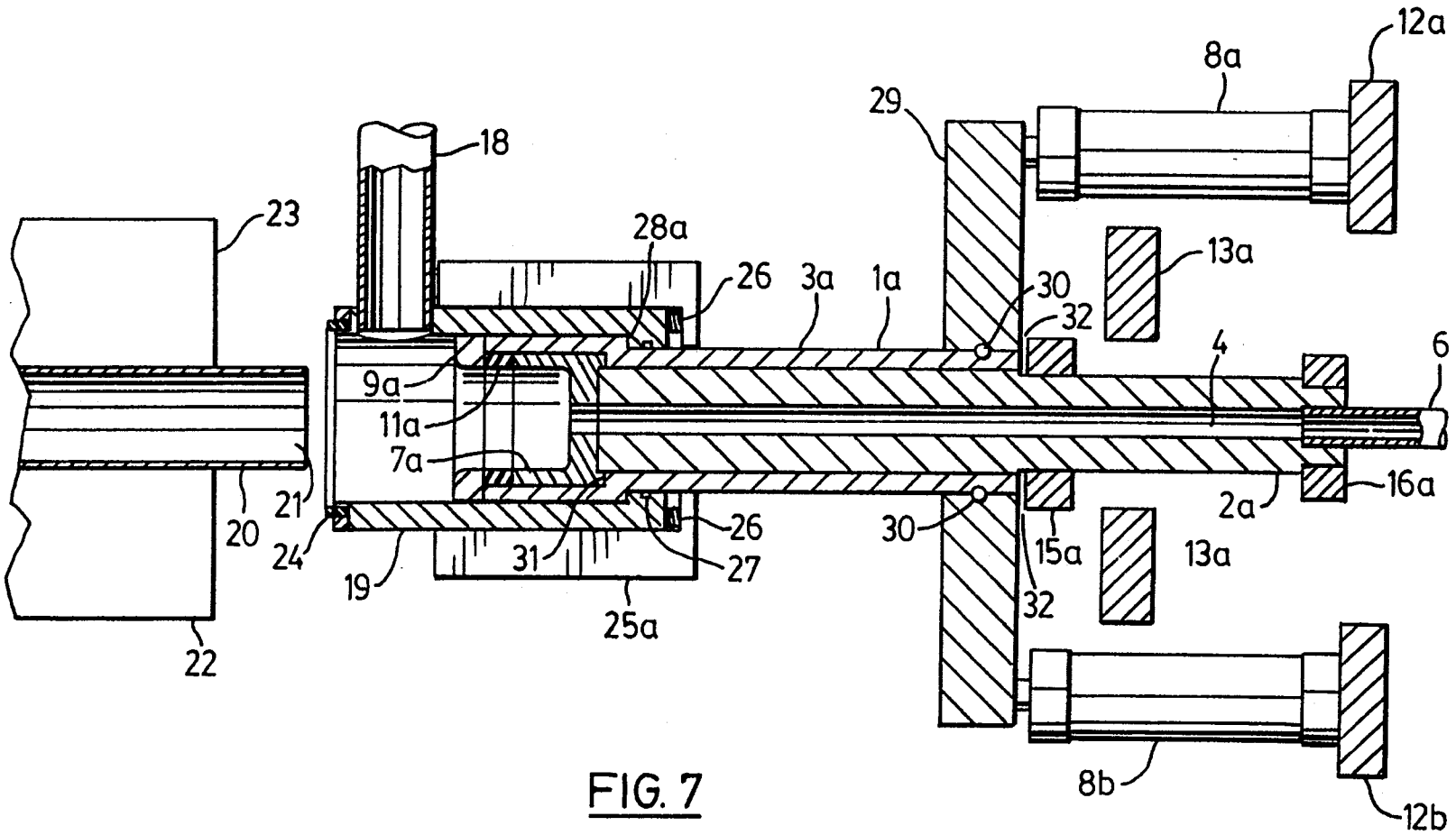
FIG. 7 shows an axial cross-sectional view of a third embodiment of the invention with tube sealing means adapted to engage and seal the outer surface of the tube which projects beyond the forming die.

Referring to FIG. 7, a second embodiment of the invention is illustrated wherein the tube sealing means are adapted to engage and seal the outer surface of the tube 20. The tube 20 projects beyond the die face 23 providing an outer surface available for sealing.

In light of the above detailed description of the first and second embodiments it is unnecessary to describe in detail the like components of the third embodiment. Like components in FIG. 7 are identified with the subscripts "a" and "b", and perform like functions.

Referring to FIG. 7 in the second embodiment of the invention the tube sealing means comprise outer sealing means adjacent the forward end of the shaft la for sealing the exterior of the tube 20. In contrast to the other embodiments described above the sleeve ring 9*a* is forward of the rod ring 7*a*. The rod ring 7*a* is connected to the forward end of the rod 2*a* and has a forward radially extending face. The sleeve ring 9*a* is connected to the forward end of the sleeve 3*a* and has a rearward radially extending face. The elastomeric ring 11*a* is positioned between the forward face of the rod ring 7*a* and the rearward face of the sleeve ring 9*a*. As described above displacing means are provided to axially displace the rod 2*a* and sleeve 3*a* thereby radially expanding and contracting the elastomeric ring 11*a* to engage and disengage the exterior of the tube 20.

The shroud 19 and the low pressure—high flow circuit operates identically as described above and therefore will not be described in detail in association with the third embodiment. The stationary support 25*a* illustrated in FIG. 7 differs slightly from the stationary support 25 in the other drawings in that the shroud is housed in and protected by the stationary support 25*a* when fully retracted.

The displacing means shown in FIG. 7 differ significantly from that of the first and second embodiments. The displacing means comprise rod backstop means, comprising two oppositely radially movable blocks 13*a*, which move inwardly toward the longitudinal axis after the shaft 1*a* has been advanced into engagement with the exterior of the tube 20. The rod backstop blocks 13*a* engage the rearward end of the rod 2*a* to prevent rearward movement of the rod 2*a* as the shaft reciprocating means rearwardly withdraws the sleeve 3*a* to seal the exterior of tile tube 20. The rearward end of the rod 2*a* includes an annular rod stop ring 16*a* protruding outwardly of the rod 2*a* to engage the rod backstop blocks 13*a*.

As described above it is desirable to limit the degree of compression of the elastomeric ring 11*a*. To this end sleeve limiting means are provided for limiting the extent to which the sleeve 3*a* may be withdrawn to seal the exterior of the tube 20 after the shaft 1*a* has been advanced to engage the exterior of the tube 20 and the rod backstop blocks 13*a* have engaged the rearward end of tile rod 2*a*. Referring to FIG. 7 the sleeve limiting means comprises a sleeve backstop ring 15*a* protruding from the rod 2*a* rearward of the sleeve 3*a* and forward of the rod stop ring 16*a*. The sleeve backstop ring 15*a* is threaded upon the rod 2*a* in order to adjust its position thereby determining the degree of compression.

In the second embodiment of the invention, the following sequence of operations is carried out. Referring to FIG. 7 the shroud 19 and shaft la are fully retracted. The forward end of the sleeve 3*a* within the shroud 19 is of enlarged diameter forming a shoulder 28 which abuts and engages the forward inner surface of the shroud 19 under the biasing action of the springs 26. The shaft reciprocating means comprise two double acting hydraulic cylinders 8*a* and 8*b* each engaging a beam 29. The beam 29 is centrally connected to the rearward end of the sleeve 3*a* by fasteners 30. The cylinders 8*a*and 8*b* are mounted on stationary members 12*a* and 12*b*, and act in a direction parallel to the longitudinal axis of the apparatus. The cylinders 8*a* and 8*b* are activated to forwardly move the shaft 1 to an intermediate position prior to engagement of the outer tube sealing means. The cylinders 8*a* and 8*b* force the sleeve 3*a* forward. The sleeve 3*a* has a forward inner shoulder 31 which abuts the rearward end of the rod ring 7*a* forcing the rod 2*a* forward. The elastomeric ring 11a is therefore not subjected to any tensile or compressive force as a result.

The gasket ring 24 at the forward end of the shroud 19 seals the external surface 23 and the tube 20 is filled with fluid by the low pressure—high flow circuit as described above.

When filling of the tube 20 with low pressure fluid is substantially completed, the shaft 1 is fully advanced such that the outer tube sealing means is positioned about the rearward end of the tube 20. The rod stop ring 16*a* is as a result advanced forward of the rod backstop blocks 13*a*. The rod backstop blocks 13*a* are moved radially inwardly to engage the rearward face of the rod stop ring 16*a* and to prevent to the rod 2*a* from moving rearwardly. The cylinders 8*a* and 8*b* are activated to retract the sleeve 3*a* rearwardly. The elastomeric ring 11*a* is compressed between the rearward face of the sleeve ring 9*a* and the forward face of the rod ring 7*a* such that the elastomeric ring 11*a* radially expands sealing the exterior surface of the tube. The retraction of the sleeve 3*a* is limited when the rearward end of the sleeve 3*a* abuts the forward face of the sleeve backstop ring 15*a* which is positioned upon the stationary rod 2*a*. The gap 32 between the rearward end of the sleeve 3*a* and sleeve backstop ring 15*a* therefore determines the degree of compression of the elastomeric ring 11*a*. The high pressure fluid means are then activated to further fill and pressurize the tube 20 as described above. Upon completion of the pressurization process the above sequence of operations is reversed in a manner which need not be fully described in light of the above detailed description.

The elastomeric ring 11*a* is of larger inner dimension than the sleeve and rod rings 9*a* and 7*a* nested inwardly between the rod and sleeve rings 7*a* and 9*a* to protect it during operation from cutting or abrading on the tube's rearward end. To aid in placing the outer tube sealing means about the tube's end and to allow for misalignment of the tube 20, the inner dimensions of the sleeve ring 9*a* are less than the inner dimensions of the rod ring 7*a*, and the inner forward edges of the sleeve ring 9*a* are rounded.

We claim:

1. A fill and pressurization apparatus for filling and pressurizing a hollow tube through an open end thereof, A. a fluid conductor in communication with a high flow-low pressure circuit and adapted to define a fluid conduit between said circuit and the open end of the tube, B. a movable shaft having a bore in communication with a low flow-high pressure circuit, said shaft movable into a position communicating said bore with the interior of the hollow tube and separating said fluid conduit therefrom.

2. An apparatus as claimed in claim 1 wherein control means controls said high flow-low pressure circuit and said low flow-high pressure circuit to actuate said high flow-low pressure circuit when said fluid conductor defines said fluid conduit to said hollow tube and to activate said low flow-high pressure circuit when said movable shaft communicates said bore with the interior of the tube and separates said fluid conduit therefrom.

3. An apparatus as claimed in claim 2 wherein said fluid conductor is adapted to surround an open end of said tube and said movable shaft includes an end portion for communicating said bore with the interior of the hollow tube and for separating said fluid conduit therefrom, said end portion being disposed within said fluid conductor.

4. An apparatus as claimed in claim 3 wherein said end portion of said shaft disposed within said fluid conductor includes a seal element to effectuate a seal between said shaft and the tube when said shaft is in said position communicating said bore with the interior of the tube and separating said high flow-low pressure fluid conduit defined by said fluid conductor therefrom.

5. An apparatus as claimed in claim 4 wherein said end portion of said shaft is sized to enter the interior of the tube.

6. An apparatus as claimed in claim 5 wherein said seal element on said end portion is a resilient seal ring and said shaft includes means operable to cause said resilient seal ring to engage the interior of the tube.

7. An apparatus as claimed in claim 4 wherein said end portion of said shaft is sized to overlie the exterior of the tube.

8. An apparatus as claimed in claim 4, wherein said shaft is reciprocable relative to said fluid conductor and a seal is provided to seal between said fluid conductor and said shaft.

9. An apparatus as claimed in claim 8 wherein said end portion of said shaft is sized to enter the interior of the tube.

10. An apparatus as claimed in claim 8 wherein said end portion of said shaft is sized to overlie the exterior of the tube.

11. An apparatus as claimed in claim 10 wherein said seal element on said end portion is a resilient seal ring and said shaft includes means operable to cause said resilient seal ring to engage the exterior of the tube.

12. An apparatus as claimed in claim 8 wherein said apparatus includes retaining means to receive and secure the tube in position relative to said fluid conductor, said shaft is disposed so as to be positioned generally coaxially of the tube when the tube is secured by said retaining means.

13. An apparatus as claimed in claim 12 wherein said fluid conductor comprises a shroud movable into and out of sealing engagement with a surface formed on said retaining means and said shroud forms said fluid conduit when engaged with said surface.

14. An apparatus as claimed in claim 13 wherein said shroud surrounds said end portion of said shaft and is reciprocal toward and away from said external surface of said retaining means.

15. An apparatus as claimed in claim 14 wherein said shroud is carried by said shaft and is reciprocal therewith, said shroud is biased relative to said shaft in a direction toward said external surface of said retaining means and includes a resilient seal element adapted to engage said external surface in sealing relation.

16. An apparatus as claimed in claim 13 wherein said shroud is carried by said shaft and is reciprocal therewith, said shroud is biased relative to said shaft in a direction toward said external surface of said retaining means and includes a resilient seal element adapted to engage said external surface in sealing relation.

* * * * *